United States Patent [19]

Hofman

[11] Patent Number: 4,906,045

[45] Date of Patent: Mar. 6, 1990

[54] CHAIR CONTROL FOR A PEDESTAL CHAIR HAVING A KNEE-TILT SEAT

[75] Inventor: William K. Hofman, Coopersville, Mich.

[73] Assignee: The Shaw-Walker Company, Muskegon, Mich.

[21] Appl. No.: 325,539

[22] Filed: Mar. 20, 1989

[51] Int. Cl.[4] ..... A47C 3/00

[52] U.S. Cl. ..... 297/300; 297/304; 248/609

[58] Field of Search ..... 297/304, 300; 248/609, 248/608

[56] References Cited

U.S. PATENT DOCUMENTS

| | | | |
|---|---|---|---|
| 2,056,965 | 10/1936 | Herold | 297/304 |
| 2,087,253 | 7/1937 | Herold | 297/304 |
| 2,800,948 | 7/1957 | Omon et al. | 248/609 |
| 2,889,868 | 6/1959 | Seenberg | 248/609 |
| 3,345,106 | 10/1967 | Tschursch et al. | 248/608 |
| 3,662,983 | 5/1972 | Wolters | 248/608 |
| 3,823,932 | 7/1974 | Simons | 248/609 |
| 4,666,121 | 5/1987 | Choong et al. | 297/304 |
| 4,718,726 | 1/1988 | Estkowski et al. | 297/304 |

*Primary Examiner*—Francis K. Zugel

*Attorney, Agent, or Firm*—Kinzer, Plyer, Dorn, McEachran & Jambor

[57] ABSTRACT

A chair control for a pedestal chair having a knee-tilt seat. An elastomeric torsion spring is offset rearwardly from the tilting axis of the seat. The seat and torsion spring are operatively connected by a cam surface and a cam follower which effectively reduce the restoring force exerted by the torsion spring against the seat as the rearward tilt of the seat increases. A mechanism to adjust the initial restoring torque of the torsion spring provides a large angular twist of the torsion spring with a minimum linear movement of the mechanism. The chair control provides the chair seat with a less than conventional seat angle relative to the horizontal when the chair is unoccupied. A mechanism is provided to enable the occupant to adjust the chair seat to a more conventional seat angle in its unoccupied condition.

11 Claims, 2 Drawing Sheets

CHAIR CONTROL FOR A PEDESTAL CHAIR HAVING A KNEE-TILT SEAT

BACKGROUND AND SUMMARY OF THE INVENTION

This invention is directed to a chair control mechanism for a pedestal-type office chair having a knee-tilt seat.

An object of this invention is a knee-tilt control mechanism which provides a high initial torque and spring rate for resisting rearward tilting movement of the chair seat and in which the restoring torque increases at less than a linear rate as the chair seat is tilted backward.

Another object of this invention is a simple, compact, knee-tilt control mechanism which can be easily concealed so that it does not detract from the aesthetic appearance of the office chair.

Another object of this invention is a knee-tilt chair control mechanism which utilizes an elastomeric spring which is offset rearwardly from the axis of tilting of the chair seat.

Another object of this invention is a knee-tilt chair control mechanism which utilizes the linearly-increasing restoring torque of an elastomeric spring to provide a less than linear restoring torque to the chair seat.

Another object of this invention is a knee-tilt chair control mechanism which utilizes the engagement of an arm connected to the chair seat with a non-radial extending cam surface connected to an elastomeric spring to reduce the effective moment arm of the spring as the angle of rearward tilt of the chair seat increases.

Another object of this invention is a simplified and compact pre-torque adjustment mechanism for an elastomeric spring which permits a large angular degree of twist of the spring upon a relatively short linear movement of the adjusting device.

Another object of this invention is a mechanism which permits the occupant of the chair to adjust the chair seat to a more conventional seat angle in its unoccupied condition.

Other objects of the invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
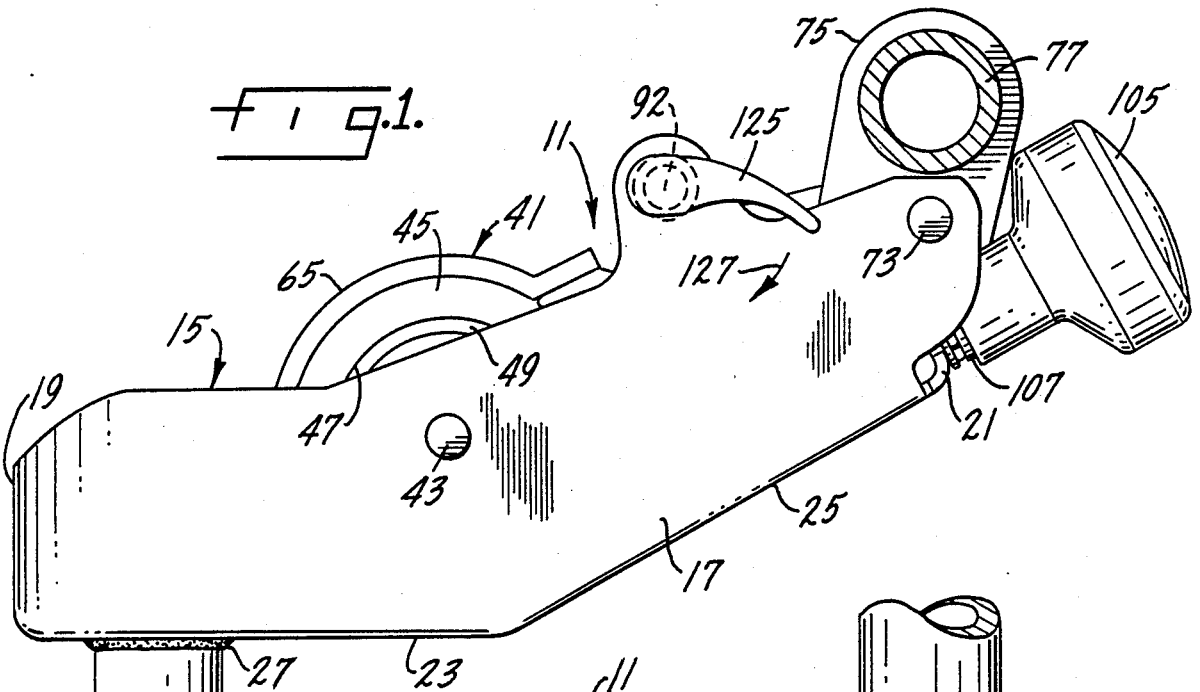
FIG. 1 is a side elevational view of the chair control of this invention showing the unoccupied rearward tilt adjustment mechanism in its disengaged position.

The chair control 11 of this invention includes a chair post tube 13 which receives the piston rod of a pneumatic lift cylinder, neither of which are shown in the drawings for simplicity and clarity of illustration. The chair control includes a hollow, open top, metal housing 15 having side walls 17, a curved rear wall 19, a partial height upturned front wall 21 and a bottom wall 23, the front portion 25 of which is inclined upwardly. The housing may be deep drawn from a single blank of metal properly cut and scored.

The chair post tube 13 extends into the housing 15 through the bottom wall 23 and is welded thereto at 27. A trefoil plate 29 is welded to the top of the chair post tube 13 and the ends of the lobes 31 of the plate are welded to the side and end walls of the housing. A threaded opening 33 is formed in the trefoil plate to receive a threaded support and pivot member fastened to the upper end of a piston rod of a pneumatic lift cylinder, neither of which are shown in the drawings. The support and pivot member is not shown because it is a conventional item supplied by the supplier of the pneumatic lift cylinder. As is conventional, the support and pivot member of the piston rod permits the chair control 11 to rotate relative to the pneumatic lift cylinder while preventing vertical displacement of the control relative to the piston rod.

Figure 4:
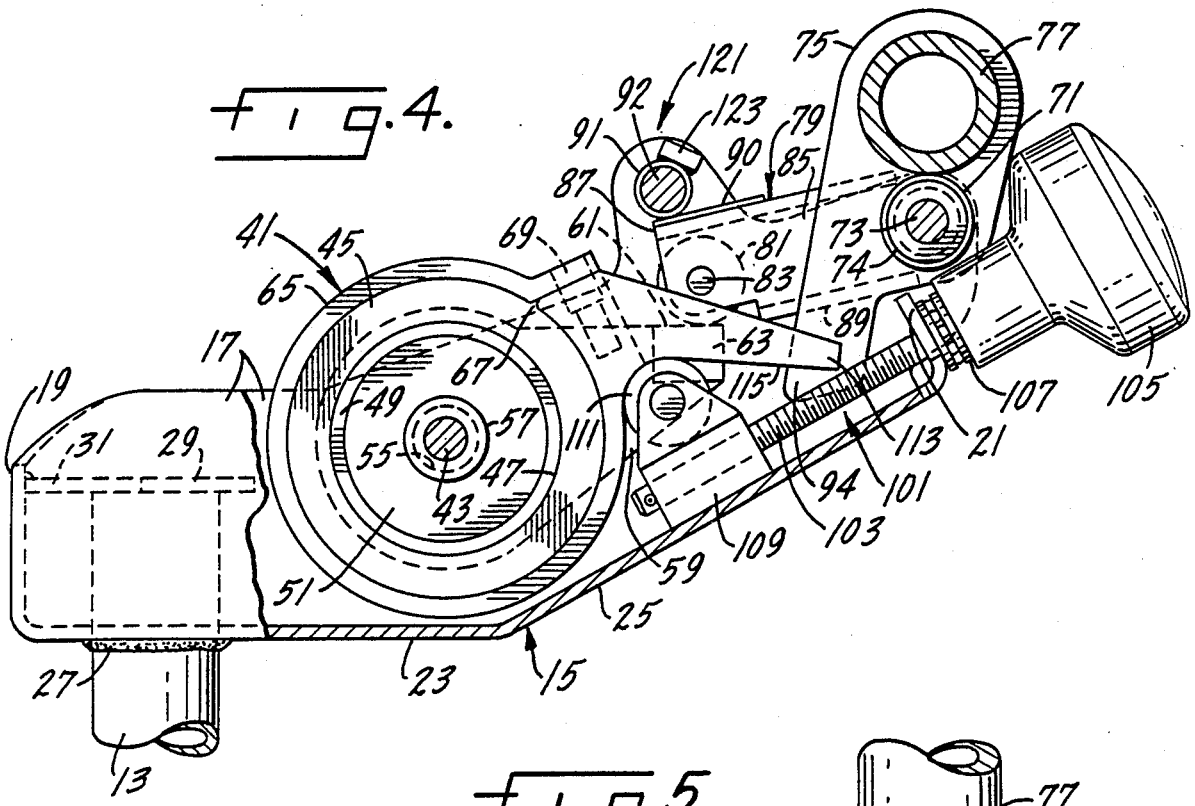
FIG. 4 is a side elevational view of the chair control of this invention, with portions of the housing cut away to show the knee-tilt chair control mechanism with the unoccupied rearward tilt adjustment mechanism in its disengaged position and the torque adjusting mechanism in its minimum position.
Figure 5:
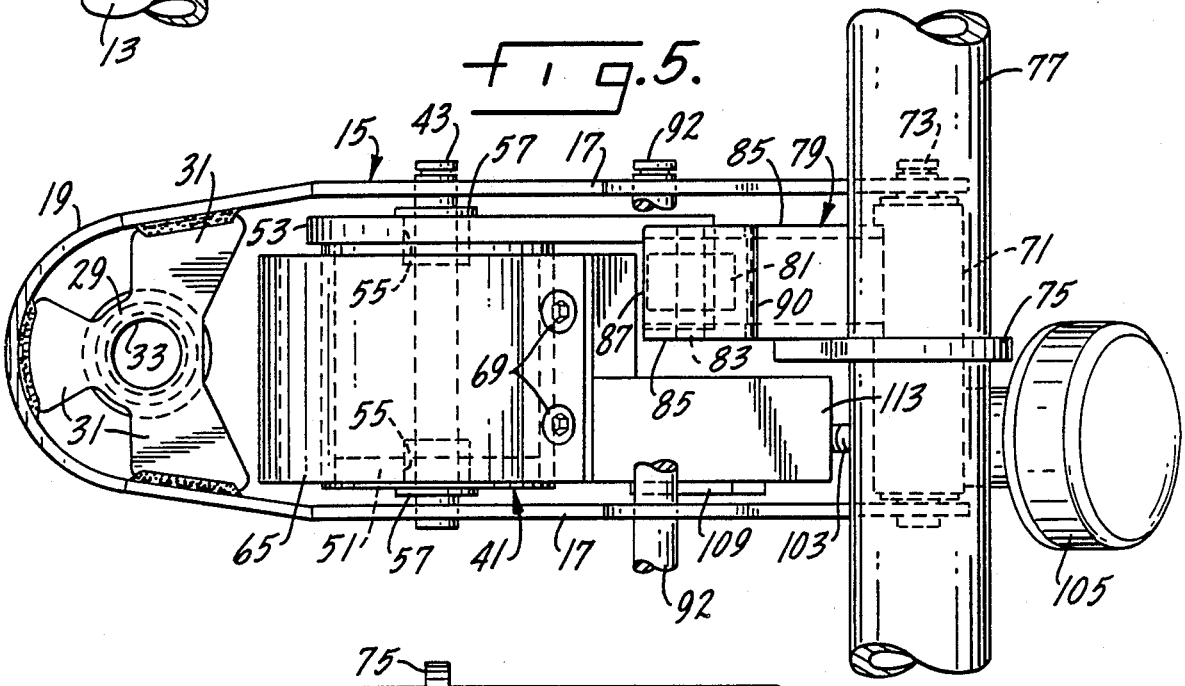
FIG. 5 is a top plan view of the chair control of FIG. 4 with some parts broken away and other parts omitted.
Figure 6:
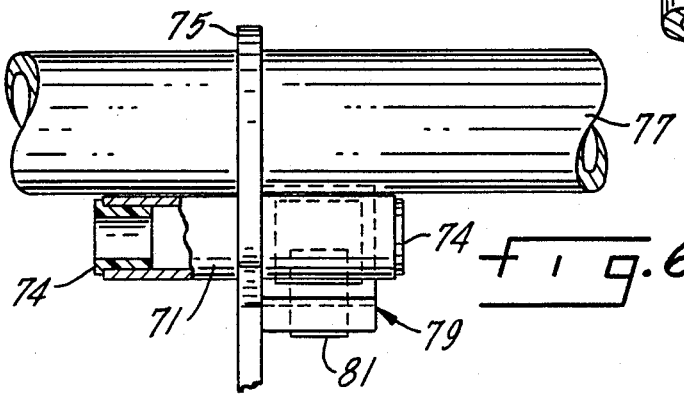
FIG. 6 is a partial end elevational view of the knee-tilt chair control mechanism with some parts broken away and others omitted for clarity of illustration.

As can be best seen in FIGS. 4 and 5 of the drawings, a torsion spring means in the form of an elastomeric spring 41 is rotatably mounted on a horizontally-extending rod 43 for twisting movement about the horizontal axis defined by the rod 43. The rod is supported on the side walls 17 of the housing and is secured against longitudinal displacement by a conventional E-clip (not shown) which snaps into a groove formed in one end of the rod located outwardly of a side wall 17 of the housing 15. This end of the rod is smaller, non-circular in cross-section and fits in a mating non-circular hole in the housing wall 17 to prevent rotation of the rod.

The elastomeric spring includes a sleeve 45 molded of a rubber-like elastomeric material having a hollow axial core or passage 47 which receives the rod 43. A metal sleeve 49 fits inside the hollow axial core of the elastomeric sleeve and the ends of the sleeve are closed by metal end caps 51 and 53, which are fastened thereto. Each end cap has a central circular opening 55 to accept a bronze bushing 57 which receives and supports the rod 43. As is conventional, the elastomeric sleeve 45 is molded around the metal sleeve 49 and between the end caps 51 and 53. The spring 41 is manufactured by The B. F. Goodrich Company and is designated as a TORSILASTIC® spring.

The metal end cap 53 has an arm 59 formed integrally therewith, and this arm has a surface which extends non-radially relative to the rod 43 of the elastomeric spring. At the distal end of the arm is a block 63 forming an axially inwardly extension having a cam surface 61. A tubular metal shell 65 is molded to the exterior surface of the elastomeric sleeve 45. In other words, the arm 59 and its metal sleeve 49 are operatively adhered to the inner surface of the elastomeric sleeve 45, while the shell 65 is operatively adhered to the outer surface of the elastomeric sleeve so that torsion forces act on the inside and outside of the elastomeric sleeve.

The tubular metal shell 65 is formed with a longitudinally-extending gap 67 formed therein, with the gap having a circumferential extent of about five degrees. After the elastomeric compound is molded between the outer metal shell 65 and inner metal sleeve 49 and allowed to cool, the gap is closed by tightening socket screws 69 to leave only a slight bulge of elastomer clamped between the edges of the shell. The clamping of the solidified elastomeric spring compound compresses the elastomer to provide the advantages referred to in U.S. Pat. Nos. 2,409,500; 2,609,194 and 2,621,923, issued to The B. F. Goodrich Company.

A seat pivot tube 71 is located near the front end of the housing 15 above the elastomeric spring 41 and is pivotally mounted for rotation about a rod 73 which is supported on and extends horizontally between the side walls 17 of the housing. A groove is formed in one end of the rod 73 which extends outwardly of the housing 15 to receive a conventional E-clip to secure the rod against longitudinal displacement in the manner explained for rod 43. Bronze bushings 74 are force fitted into the ends of the tube 71 to provide bearing surfaces for the rod 73. Welded to the seat pivot tube 71 is a generally upstanding bracket 75. Near its upper end, the bracket 75 receives and is welded to a stretcher tube 77. The ends of the stretcher tube, which are not shown in the drawings, are attached to the underside of a chair shell, which also is not shown. A modified piece 79 of square steel tubing is welded at one end to the rear side of the seat pivot tube 71 and to the bracket 75. A cam roller 81 is journaled on a shaft 83 mounted on and extending between the side walls 85 of the square tubing near the free end 87 thereof. The side walls 85 and the bottom wall 89 of the square tubing are cut away at the free end 87 to allow the cam roller 81 to engage and ride on the cam surface 61 of the block 63 of the elastomeric spring arm 59 to bias the seat pivot tube 71 in a clockwise direction, as viewed in FIG. 1 of the drawings. This clockwise rotation of the seat pivot tube tilts the chair seat forward. For production quantities, it may be desirable to form the piece 79 from a blank of metal which is properly cut, scored and bent rather than to modify a piece of square tubing in the manner previously described.

Figure 2:
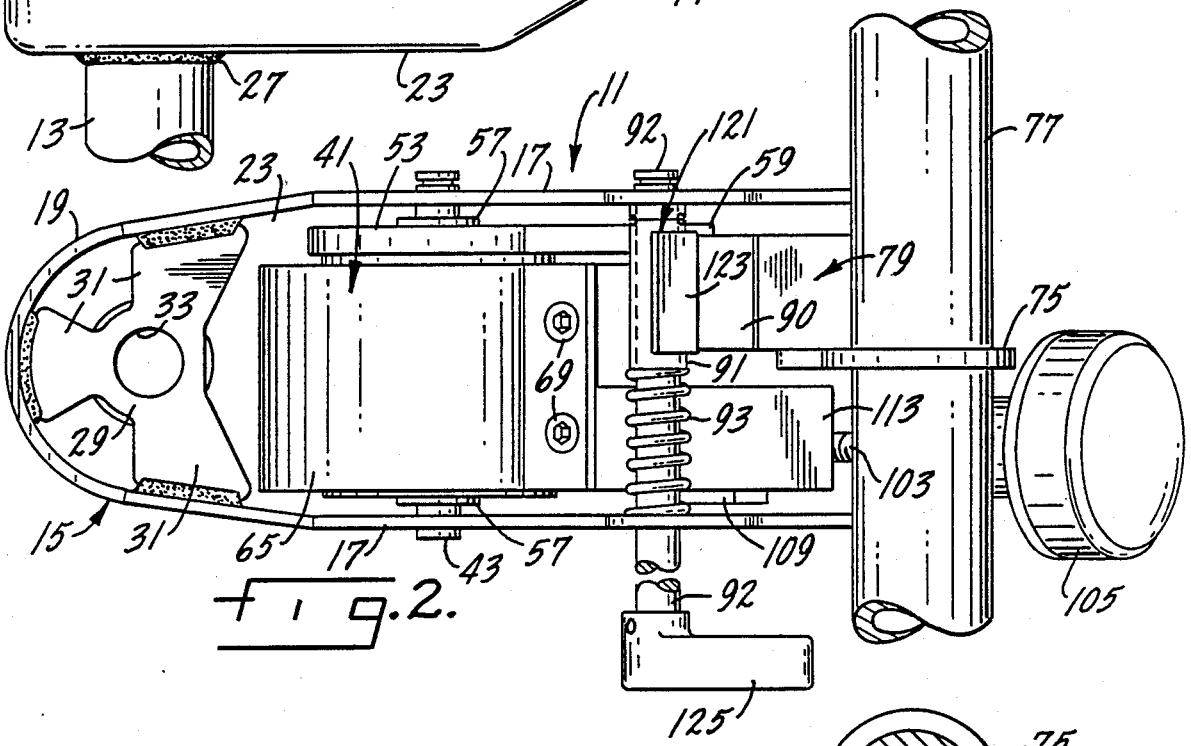
FIG. 2 is a top plan view of the chair control of FIG. 1 with some parts broken away.

Although not shown in the drawings, the seat pivot tube 71, bracket 75 and the chair shell they support provide the seat with a rearward tilt of approximately one degree when the chair is unoccupied. This rearward tilt of the seat when unoccupied is less than that conventionally provided for an office chair which is in the range of one to five degrees. This rearward tilt of the chair seat is conventionally referred to as the seat angle. Forward rotation of the seat pivot tube 71 and the bracket 75 are limited by engagement of a wear plate 90 on the top of the piece 79 of square steel tubing with a sleeve 91 which is telescoped over a rod 92. The rod 92 is mounted on the side walls 17 of the housing 15 and extends outwardly of both side walls of the housing, as shown most clearly in FIG. 2 of the drawings. A groove is formed in one end of the rod to receive a conventional E-clip to secure the rod against longitudinal displacement. The sleeve 91 is held against lateral movement by a compression spring 93 which telescopes over the rod 92. The sleeve 91 is pinned to the rod 92 to rotate therewith.

When the chair is occupied, the seat pivot tube 71 and the piece 79 of square steel tubing rotate in a counterclockwise direction under the weight of the occupant, as viewed in FIG. 4 of the drawings, to rotate the arm 59 of the elastomeric spring 41 in a clockwise direction, also as viewed in FIG. 4 of the drawings. Since the cam surface 61 extends non-radially relative to the rod 43 about which the elastomeric spring 41 rotates, increased rotation of the seat pivot tube 71 and elastomeric spring 41 under load increases the effective moment arm length 59 of the elastomeric spring and thereby decreases the return force exerted by the elastomeric spring against the seat pivot tube 71. Therefore, the return torque resisting force of the chair control which is attempting to return the seat to its forward position is not linear throughout the entire range of tilt of the chair seat.

The return torque resisting force increases at much the same linear rate as the return force exerted by the elastomeric spring 41 during approximately the first four degrees of rearward tilt, but falls below a linear increase in return torque as the chair seat is rotated beyond the initial four degree rearward tilt to its maximum rearwardly-tilted position. This result is achieved by offsetting the axis 43 of rotation of the spring 41 relative to the axis 73 of rotation of the seat pivot tube 71 and through the use of a cam surface and cam follower in which the effective length of the spring moment arm increases as the chair seat is tilted. The maximum rearwardly-tilted position of the chair seat is determined by engagement of the toe 94 of the bracket 75 with the inclined wall 25 of the housing 15. In normal operation, the force exerted by the elastomeric spring will prevent the bracket 75 from rotating to this position.

The initial torque exerted against the seat pivot tube 71 when the chair seat is in its unoccupied position can be adjusted using a screw adjustment mechanism 101. A threaded shaft 103 having a knob 105 is mounted in a thrust bearing assembly 107 fastened to the partial height front wall 21 of the housing 15. The threaded shaft 103 extends generally tangentially to the spring 41. A yoke block 109 rides on the threaded shaft 103 and carries a roller 111 on the block. The shell 65 of the spring 41 has an integrally-formed arm 113 with an inclined cam surface 115, which is engaged by the roller 111 of the yoke block 109. The path of movement of the yoke block 109 away from the spring 41 intersects the inclined cam surface at an acute angle, which angle decreases as the yoke block is moved toward the front wall 21 of the housing 15. As the yoke block 109 is moved toward the front wall 21 of the housing by rotation of the threaded shaft 103, engagement of the roller 111 with the inclined cam surface 115 of the arm 113 rotates the shell 65 in a counterclockwise direction, as viewed in FIG. 4 of the drawings, to twist the outer surface of the elastomeric spring sleeve 45 and increase the torque exerted by the spring 41. Because of the relationship of the inclined cam surface 115 and the path of movement of the yoke block 109, a short linear movement of the yoke block 109 provides a large angular twist of the elastomeric spring sleeve 45. Also, the amount of torque required to turn the threaded shaft 103 remains relatively constant as the spring 41 is twisted to its maximum initial torque condition because the effective moment arm 113 exerted by the roller 111 increases as the yoke block 109 is moved away from the spring 41.

Figure 3:
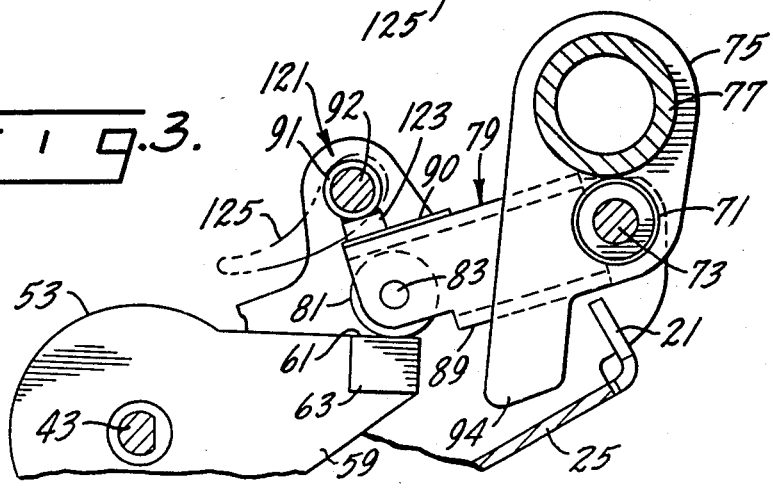
FIG. 3 is a partial side elevational view of the chair control of this invention showing the unoccupied rearward tilt adjustment mechanism in its engaged position, with the handle of the tilt adjustment mechanism shown in phantom lines and having parts broken away.

To limit the forward tilt of the chair seat to a more conventional rearwardly-tilted position which is greater than the one degree rearward tilt provided when the chair is unoccupied, a mechanism 121 is provided. This mechanism includes a block 123, most clearly shown in FIGS. 2, 3 and 4 of the drawings, which is welded to sleeve 91, which in turn is pinned to the shaft 92. The block 123 is aligned with the wear plate 90 on the square piece 79 of steel tubing extending from the seat pivot tube 71. A handle 125 is fastened to the end of the shaft 92 which is located outside of the housing 15, as can best be seen in FIG. 2. When the mechanism 121 is in its disengaged position, shown in FIGS. 1, 2 and 4 of the drawings, the block 123 is rotated out of contact with the wear plate 90. The occupant can limit the forward rotation of the chair seat by engagement of the limit mechanism 121. This is accomplished by the occupant who tilts the seat rearwardly to rotate the piece of steel tubing 79 and its wear plate 90 from contact with the sleeve 91 of the rod 92. The occupant then rotates the handle 125 in a clockwise direction, as viewed in FIG. 1 and shown by the arrow 127. This rotates the block 123 from the position shown in FIG. 4 to the position shown in FIG. 3, where it contacts the wear plate 90 of the arm 79 and limits forward tilting motion of the seat. The engagement of the limit mechanism 121 does not interfere with the rearward tilting of the seat or its return to the position shown in FIG. 3. The limit mechanism 121 will remain in its engaged position until the occupant wishes to rotate the handle 125 to disengage it.

I claim:

1. A chair control for a pedestal chair having a knee-tilt seat, a chair post tube and a housing extending between said knee-tilt seat and said chair post tube, said chair control including:

a seat support pivot member pivotally mounted on said housing for rotation about a generally horizontal axis located forward of said chair post tube, means mounted on said seat support pivot member for supporting said seat, a torsion spring means mounted on said housing rearwardly of said seat support pivot member for rotation about a generally horizontal axis, cam follower means and an arm having cam surface means, one of said means and said arm attached to one of said seat support pivot means and said torsion spring means, with said cam surface means engaging said cam follower means to bias said seat support pivot member to tilt said seat forwardly, one of said arms having cam surface means and cam follower means extending non-axially relative to the horizontal axis of rotation of its means, the engagement between said cam follower means and said cam surface means moving farther away from the horizontal axis of rotation of its means as said support pivot member rotates from its unoccupied position to its fully rearwardly-tilted position to thereby effectively decrease the force exerted by said torsion spring means against said seat support pivot member.

2. The chair control of claim 1 including means to adjust the amount of torque initially exerted by said torsion spring means against said seat support pivot member.

3. The chair control of claim 1 in which said cam follower means is a roller.

4. The chair control of claim 1 in which said torsion spring means is a tubular elastomeric spring.

5. The chair control of claim 4 in which the cam surface arm is affixed to an inner surface of the tubular elastomeric spring.

6. The chair control mechanism of claim 1 further including means to selectively prevent the seat support pivot member from rotating the seat to its maximum forwardly tilt position.

7. The chair control mechanism of claim 6 in which said means to selectively prevent the seat support pivot member from rotating the seat to its maximum forwardly tilt position includes a stop member which engages said cam follower means, said stop member having a block formed thereon, and means to rotate said stop member to move said block into and out of engagement with said cam follower means to restrict forward rotation of said seat support pivot member when said block engages said cam follower means.

8. The chair control of claim 2 in which said means to adjust the amount of torque initially exerted by said torsion spring means against said seat support pivot member includes a lever affixed to said torsion spring means, a straight cam surface formed on said lever, a cam follower roller mounted for linear movement along a path toward and away from said torsion spring means and which intersects the straight cam surface at an acute angle, which angle decreases as the roller moves away from the torsion spring means, and means to move said cam follower roller along said linear path to increase or decrease the amount of torque initially exerted by the torsion spring means.

9. A chair control mechanism for a pedestal chair having a knee-tilt seat, said control including:

means to tilt said chair rearwardly about a generally horizontal axis located near the front of the seat, an elastomeric torsion spring means located rearwardly of said generally horizontal axis, said torsion spring exerting a linearly increasing return torque as it is twisted, and cam and cam follower means associated with said seat tilt means and said elastomeric torsion spring means to reduce the return torque applied by the torsion spring means against the seat tilt means to less than the linearly increasing rate of the spring means as the seat is tilted to its fully rearwardly-tilted position.

10. A mechanism for adjusting the torque initially exerted by a chair control torsion spring means, including:

a lever affixed to said torsion spring means and adapted to twist said spring means and increase the torque applied by said spring means upon movement of said lever, a straight cam surface formed on said lever, a cam follower roller mounted for linear movement along a path toward and away from said torsion spring means, said path intersecting said straight cam surface at an acute angle, which angle decreases as the roller moves away from the torsion spring means along said path, and means to move said cam follower roller along said linear path to increase or decrease the torque initially exerted by said torsion spring means.

11. The mechanism of claim 10 in which said torsion spring means is an elastomeric spring.

* * * * *

UNITED STATES PATENT AND TRADEMARK OFFICE

CERTIFICATE OF CORRECTION

PATENT NO. : 4,906,045

DATED : March 6. 1990

INVENTOR(S) : William K. Hofman

It is certified that error appears in the above-identified patent and that said Letters Patent is hereby corrected as shown below:

On the title page item [56] references cited should read as follows:

U.S. Patent Documents

| Patent Number | Date (M/Y) | Name |
|---|---|---|
| 2,142,872 | 01/39 | Haushalter |
| 2,226,406 | 12/40 | Krotz |
| 2,325,132 | 07/43 | Haushalter et al. |
| 2,327,113 | 08/43 | Krotz |
| 2,345,201 | 03/44 | Krotz |
| 2,396,579 | 03/46 | Krotz |
| 2,409,500 | 10/46 | Krotz |
| 2,582,426 | 01/52 | Greene |
| 2,609,194 | 09/52 | Krotz |
| 2,621,923 | 12/52 | Krotz |
| 2,633,897 | 04/53 | Moore |
| 2,715,022 | 08/55 | Krotz |

UNITED STATES PATENT AND TRADEMARK OFFICE

CERTIFICATE OF CORRECTION

PATENT NO. : 4,906,045

DATED : March 6, 1990

INVENTOR(S) : William K. Hofman

It is certified that error appears in the above-identified patent and that said Letters Patent is hereby corrected as shown below:

| | | |
|---|---|---|
| 3,706,481 | 12/72 | Kramer |
| 3,989,297 | 11/76 | Kerstholt |
| 4,364,605 | 12/82 | Meiller |
| 4,529,247 | 07/85 | Stumpf et al. |
| 4,640,548 | 02/87 | Desanta |
| 4,682,814 | 07/87 | Hansen |
| 4,685,733 | 08/87 | Machate et al. |
| 4,796,950 | 01/89 | Mrotz, III et al. |

Signed and Sealed this

Twenty-first Day of May, 1991

*Attest:*

*Attesting Officer*

HARRY F. MANBECK, JR.

*Commissioner of Patents and Trademarks*